US008228253B2

(12) United States Patent
Berejik

(10) Patent No.: US 8,228,253 B2
(45) **Date of Patent: *Jul. 24, 2012**

(54) VEHICLE MOUNTED ANTENNA AND METHODS FOR TRANSMITTING AND/OR RECEIVING SIGNALS

(75) Inventor: Zacharia Berejik, Tel-Aviv (IL)

(73) Assignee: Mobile Sat Ltd., Tel-Aviv (IL)

( * ) Notice: Subject to any disclaimer, the term of this patent is extended or adjusted under 35 U.S.C. 154(b) by 0 days.

This patent is subject to a terminal disclaimer.

(21) Appl. No.: 13/041,463

(22) Filed: Mar. 7, 2011

(65) Prior Publication Data

US 2011/0156948 A1 Jun. 30, 2011

Related U.S. Application Data

(63) Continuation of application No. 12/076,085, filed on Mar. 13, 2008, now Pat. No. 7,911,403.

(60) Provisional application No. 60/907,010, filed on Mar. 16, 2007.

(51) Int. Cl.
*H01Q 3/20* (2006.01)

(52) U.S. Cl. ..... 343/761; 343/713; 343/757; 343/765; 343/781 P

(58) Field of Classification Search ..... 343/713, 343/754, 755, 757, 761, 765, 781 CA, 781 P
See application file for complete search history.

(56) References Cited

U.S. PATENT DOCUMENTS

| | | | | |
|---|---|---|---|---|
| 3,243,805 | A * | 3/1966 | Smith, Jr. | 342/80 |
| 3,276,022 | A * | 9/1966 | Brunner | 343/727 |
| 3,407,404 | A * | 10/1968 | Cook et al. | 343/765 |
| 3,821,746 | A * | 6/1974 | Betsudan et al. | 343/781 R |
| 4,408,209 | A | 10/1983 | Urien et al. | |
| 4,668,955 | A | 5/1987 | Smoll | |
| 5,021,798 | A | 6/1991 | Ubhayakar | |
| 5,175,562 | A | 12/1992 | Rappaport | |
| 5,714,947 | A | 2/1998 | Richardson et al. | |
| 6,172,650 | B1 | 1/2001 | Ogawa et al. | |
| 6,198,455 | B1 | 3/2001 | Luh | |
| RE37,218 | E | 6/2001 | Densmore et al. | |
| 6,747,604 | B2 | 6/2004 | Amyotte et al. | |
| 6,795,031 | B1 | 9/2004 | Walker et al. | |
| 6,977,622 | B2 * | 12/2005 | Hay et al. | 343/781 P |
| 7,450,079 | B1 * | 11/2008 | Baldauf et al. | 343/781 CA |
| 7,911,403 | B2 * | 3/2011 | Berejik | 343/761 |
| 2003/0071758 | A1 | 4/2003 | Bien et al. | |

(Continued)

FOREIGN PATENT DOCUMENTS

| | | |
|---|---|---|
| EP | 0139482 | 5/1985 |

(Continued)

OTHER PUBLICATIONS

Communication Pursuant to Article 94(3) EPC Dated Jun. 30, 2010 From the European Patent Office Re. Application No. 08719975.8.

(Continued)

*Primary Examiner* — Tho G Phan

(57) ABSTRACT

An antenna for communicating with a satellite from a moving vehicle. The antenna comprises a transmitter for generating a transmission signal, main and sub reflectors, and a waveguide associated with the transmitter for conducting the transmission signal toward the sub reflector. The sub reflector is configured for redirecting the transmission signal toward the main reflector; the main reflector is configured for projecting the redirected transmission signal as an antenna beam toward the satellite.

23 Claims, 11 Drawing Sheets

U.S. PATENT DOCUMENTS

| | | | |
|---|---|---|---|
| 2003/0128168 | A1 | 7/2003 | Desargant et al. |
| 2007/0182654 | A1 | 8/2007 | Rao et al. |
| 2008/0309569 | A1 | 12/2008 | Berejik |

FOREIGN PATENT DOCUMENTS

| | | |
|---|---|---|
| EP | 0845833 | 6/1998 |
| EP | 1291965 | 3/2003 |
| EP | 1014483 | 8/2003 |
| WO | WO 02/07256 | 1/2002 |
| WO | WO 2008/015647 | 2/2008 |
| WO | WO 2008/114246 | 9/2008 |

OTHER PUBLICATIONS

Communication Relating to the Results of the Partial International Search Dated Jul. 25, 2008 From the International Searching Authority Re.: Application No. 2008/000350.

International Preliminary Report on Patentability Dated Jun. 3, 2009 From the International Preliminary Examining Authority Re.: Application No. PCT/IL2008/000350.

International Search Report Date Oct. 22, 2008 From the International Searching Authority Re.: Application No. PCT/IL2008/000350.

Notice of Allowance Dated Jan. 7, 2011 From the US Patent and Trademark Office Re.: U.S. Appl. No. 12/076,085.

Official Action Dated Mar. 11, 2010 From the US Patent and Trademark Office Re.: U.S. Appl. No. 12/076,085.

Official Action Dated May 14, 2010 From the US Patent and Trademark Office Re.: U.S. Appl. No. 12/076,085.

Official Action Dated Oct. 27, 2010 From the US Patent and Trademark Office Re.: U.S. Appl. No. 12/076,085.

Response Dated Apr. 12, 2010 to Official Action of Mar. 11, 2010 From the US Patent and Trademark Office Re.: U.S. Appl. No. 12/076,085.

Response Dated Aug. 12, 2010 to Official Action of May 14, 2010 From the US Patent and Trademark Office Re.: U.S. Appl. No. 12/076,085.

Response Dated Oct. 28, 2010 to Communication Pursuant to Article 94(3) EPC of Jun. 30, 2010 From the European Patent Office Re. Application No. 08719975.8.

Written Opinion Dated Oct. 22, 2008 From the International Searching Authority Re.: Application No. PCT/IL2008/000350.

Choung "Dual-Band Offset Gimballed Reflectore Antenna", TRW Space & Electronics Group, p. 214-217, 1996.

Densmore et al. "A Satellite-Tracking K- and Kα-Band Mobile Vehicle Antenna System", IEEE Transactions on Vehicular Technology, 42(4): 502-513, 1993.

Schena et al. "FIFTH Project Solutions Demonstrating New Satellite Broadband Communication System for High Speed Train", IEEE 59th Vehicular Technology Conference, VTC 2004-Spring, Milano, Italy May 17-19, 2004, XP010766766, 5: 2831-2835, May 17, 2004.

* cited by examiner

VEHICLE MOUNTED ANTENNA AND METHODS FOR TRANSMITTING AND/OR RECEIVING SIGNALS

RELATED APPLICATIONS

The present application is a continuation of U.S. patent application Ser. No. 12/076,085, filed on Mar. 13, 2008 which claims the benefit of priority under 35 USC 119(e) of U.S. Provisional Patent Application No. 60/907,010, filed on Mar. 16, 2007, the contents of which are herein incorporated by reference.

FIELD AND BACKGROUND OF THE INVENTION

The present invention, in some embodiments thereof, relates to an apparatus and a method for vehicle-mounted antennas and, more particularly, but not exclusively, to an apparatus and a method for vehicle-mounted antennas for satellite communication.

There is increasing interest in implementing broadband communicating systems on various forms of mobile platforms, for example, maritime vessels and land vehicles. With a broadband satellite communicating system that has an antenna mounted on a vehicle, the antenna is used to help form a communications link with a space-based satellite in geosynchronous orbit. The antenna forms part of a communications terminal that is carried by the vehicle.

Antennas with an ability to track, with high precision, communication satellites from mobile platforms such as aircraft, ships and land vehicles are required, inter alia, for optimizing data rate, improving the efficiency of downlink and uplink transmission, and/or preventing interference with satellites orbiting adjacent to a target satellite. Such antennas allow mobile satellite communication platforms that have relatively high attitude accelerations, such as aircraft and land vehicles to receive signals from and/or to transmit signals to satellites such as geostationary satellites.

In order to collect the signals from the remote sources and/or in order to transmit signals to thereto, it is necessary to keep the antenna pointed at the satellite while taking the movement of a vehicle into account. In order to allow the antenna to point at the satellite, the vehicle-mounted antennas are made to track side-to-side (azimuth) and up and down (elevation). However, it should be noted that in order to avoid interfering with the smooth airflow over the vehicle or adversely affecting the aesthetics of the vehicle, the profile of the vehicle-mounted antennas has to remain low.

For example, International Patent Application Pub. No. WO/2008/015647, published on Feb. 7, 2008 describes a dual reflector offset mechanical pointing low profile telecommunication antenna, to be used above all on vehicles, even high-speed ones. Its reduced physical dimensions facilitate its use, with respect to the known solutions, as it allows its connecting to the communicating system, such as a satellite, though installed on a train or on an aircraft. The invention lies within the technical field of telecommunications and the applicative field of stationary, movable antennas of reduced dimensions, and accordingly within that of telecommunications in general. The original dual reflector antenna is obtained from a second-order polynomial that configurates it in the Cartesian space XYZ.

SUMMARY OF THE INVENTION

According to an aspect of some embodiments of the present invention there is provided an antenna for communicating with a satellite from a moving vehicle. The antenna comprises a transmitter for generating a transmission signal, main and sub reflectors, and a waveguide associated with the transmitter for conducting the transmission signal toward the sub reflector. The sub reflector is configured for redirecting the transmission signal toward the main reflector, the main reflector being configured for projecting the redirected transmission signal as an antenna beam toward the satellite.

Optionally, the waveguide having a bended passage.

More optionally, the bended passage having a bending angle of at least 5 degrees.

Optionally, the waveguide having a feed horn connected to its end, the waveguide being configured for conducting the transmission signal toward the sub reflector via the feed horn.

More optionally, the main reflector is disposed between the transmitter and the feed horn.

Optionally, the transmitter is connected to a polarizing element, the waveguide being used for guiding the transmission signal between the polarizing element and the feed horn.

Optionally, the antenna further comprises a calibration track configured for allowing the adjustment of the position of the waveguide in relation to the sub reflector to calibrate the antenna beam.

More optionally, the polarizing element is a rotating orthomode transducer (OMT) configured for associating between the transmitter, a receiver, and the waveguide, the OMT being configured for rotating around the central axis of the waveguide for polarizing the transmission signal.

More optionally, the rotating OMT allowing a non-orthogonal assembly of the transmission signal and a satellite signal received via the waveguide.

More optionally, the positioning of the waveguide in relation to the main and sub reflectors is fixed during the rotating.

More optionally, the antenna further comprises first and second rotary joints, the first rotary joint being disposed between the OMT and the waveguide and the second rotary joint being disposed between the OMT and at least one of a down converter, the transmitter, and a low noise block (LNB) downconverter.

More optionally, the at least one of the first and second rotary joints is less than 1 centimeter length.

More optionally, the first and second rotary joints allows adjusting the polarization of the transmission signal by facilitating the rolling of the polarizing element around the central axis of the waveguide while maintaining the waveguide firmly fixed in relation to the main and sub reflectors.

Optionally, the antenna further comprises an actuating unit configured for adjusting a tilting angle of the main reflector to maintain a line of sight between the moving vehicle and the satellite.

Optionally, the actuating unit is configured for adjusting the tilting angle during a motion of the moving vehicle.

More optionally, the antenna further comprises a rotational base for supporting the main and sub reflectors and the waveguide on the moving vehicle, the actuating unit being configured for adjusting a rotation angle of the rotational base to maintain a line of sight between the moving vehicle and the satellite.

According to an aspect of some embodiments of the present invention there is provided an antenna for communicating with a satellite from a moving vehicle. The antenna comprises a rotational base configured for being mounted on the moving vehicle, a main reflector configured for being tilted around a tilting axis located in a proximity to a lower portion of the main reflector, a feed for emitting a transmission signal, and a sub reflector configured for redirecting the transmission signal toward the main reflector, the main reflector being configured for projecting the redirected transmission signal as an antenna beam toward the satellite. The tilting allows the maintaining of a line of sight between the main reflector and the satellite during a motion of the moving vehicle.

Optionally, the feed and the sub reflector remain substantially stationary in relation to the rotational base during the tilting.

Optionally, the antenna beam having a main lobe, the tilting allows the tilting of the center of the main lobe in a range of at least 50 degrees in relation to the rotational base without a gain degradation of more than 2 decibels.

More optionally, the tilting allows the tilting of the center of the main lobe in a range of at least 60 degrees.

Optionally, the tilting is performed by at least one supporting element, the main reflector and the at least one supporting element being detachably coupled.

More optionally, the range is between tilting angles of more than 15 degrees in relation to the rotational base.

Optionally, the antenna further comprises a radome having a substantially flat top for covering the main and sub reflectors.

Optionally, at least one of the sub and main reflectors having a substantially ellipsoidal inner reflective surface profile.

Optionally, the feed is configured for radiating the sub reflector with a substantially ellipsoidal conical beam to create an ellipsoidal radiation spot on the sub reflector.

More optionally, the sub reflector is configured for redirecting the ellipsoidal radiation spot toward the main reflector to create an additional ellipsoidal radiation spot thereon, wherein the width-height ratio of the additional ellipsoidal radiation spot is higher than the width-height ratio of the ellipsoidal radiation spot.

Optionally, the ellipsoidal radiation spot having a width-height ratio of at least 1.6:1.

More optionally, the additional ellipsoidal radiation spot is at least 4:1.

Optionally, the feed having a pair of opposing ends for creating the substantially ellipsoidal conical beam.

More optionally, the antenna lobe has a gain selected from a group consisting of at least 30 decibel isotropic (dBi) at 14 GHz and at least 25 decibel isotropic (dBi) at 11 GHz.

Optionally, the antenna further comprises a transmitter configured for emitting the transmission signal and a waveguide for conducting the transmission signal toward the feed.

According to an aspect of some embodiments of the present invention there is provided a method for transmitting a transmission signal to a satellite. The method comprises providing a transmission signal, polarizing the transmission signal, using a waveguide for conducting the polarized transmission signal toward a sub reflector, and redirecting the conducted polarized transmission signal toward a main reflector to allow the projecting thereof toward the satellite as an antenna beam.

According to an aspect of some embodiments of the present invention there is provided a method for receiving a communication signal from a satellite. The method comprises tilting a main reflector of an antenna mounted on a vehicle to allow a reception of the communication signal during a motion of the vehicle, redirecting the communication signal toward a sub reflector, the sub reflector being positioned in front of a waveguide, using the waveguide for directing a reflection of the redirected communication signal from the sub reflector toward a polarizing element, and polarizing the directed reflection to allow the reception of the communication signal from the satellite during the motion.

Unless otherwise defined, all technical and/or scientific terms used herein have the same meaning as commonly understood by one of ordinary skill in the art to which the invention pertains. Although methods and materials similar or equivalent to those described herein can be used in the practice or testing of embodiments of the invention, exemplary methods and/or materials are described below. In case of conflict, the patent specification, including definitions, will control. In addition, the materials, methods, and examples are illustrative only and are not intended to be necessarily limiting.

Implementation of the method and/or system of embodiments of the invention can involve performing or completing selected tasks manually, automatically, or a combination thereof. Moreover, according to actual instrumentation and equipment of embodiments of the method and/or system of the invention, several selected tasks could be implemented by hardware, by software or by firmware or by a combination thereof using an operating system.

For example, hardware for performing selected tasks according to embodiments of the invention could be implemented as a chip or a circuit. As software, selected tasks according to embodiments of the invention could be implemented as a plurality of software instructions being executed by a computer using any suitable operating system. In an exemplary embodiment of the invention, one or more tasks according to exemplary embodiments of method and/or system as described herein are performed by a data processor, such as a computing platform for executing a plurality of instructions. Optionally, the data processor includes a volatile memory for storing instructions and/or data and/or a non-volatile storage, for example, a magnetic hard-disk and/or removable media, for storing instructions and/or data. Optionally, a network connection is provided as well. A display and/or a user input device such as a keyboard or mouse are optionally provided as well.

BRIEF DESCRIPTION OF THE DRAWINGS

Some embodiments of the invention are herein described, by way of example only, with reference to the accompanying drawings. With specific reference now to the drawings in detail, it is stressed that the particulars shown are by way of example and for purposes of illustrative discussion of embodiments of the invention. In this regard, the description taken with the drawings makes apparent to those skilled in the art how embodiments of the invention may be practiced.

In the drawings.

DESCRIPTION OF SPECIFIC EMBODIMENTS OF THE INVENTION

Figure 1:
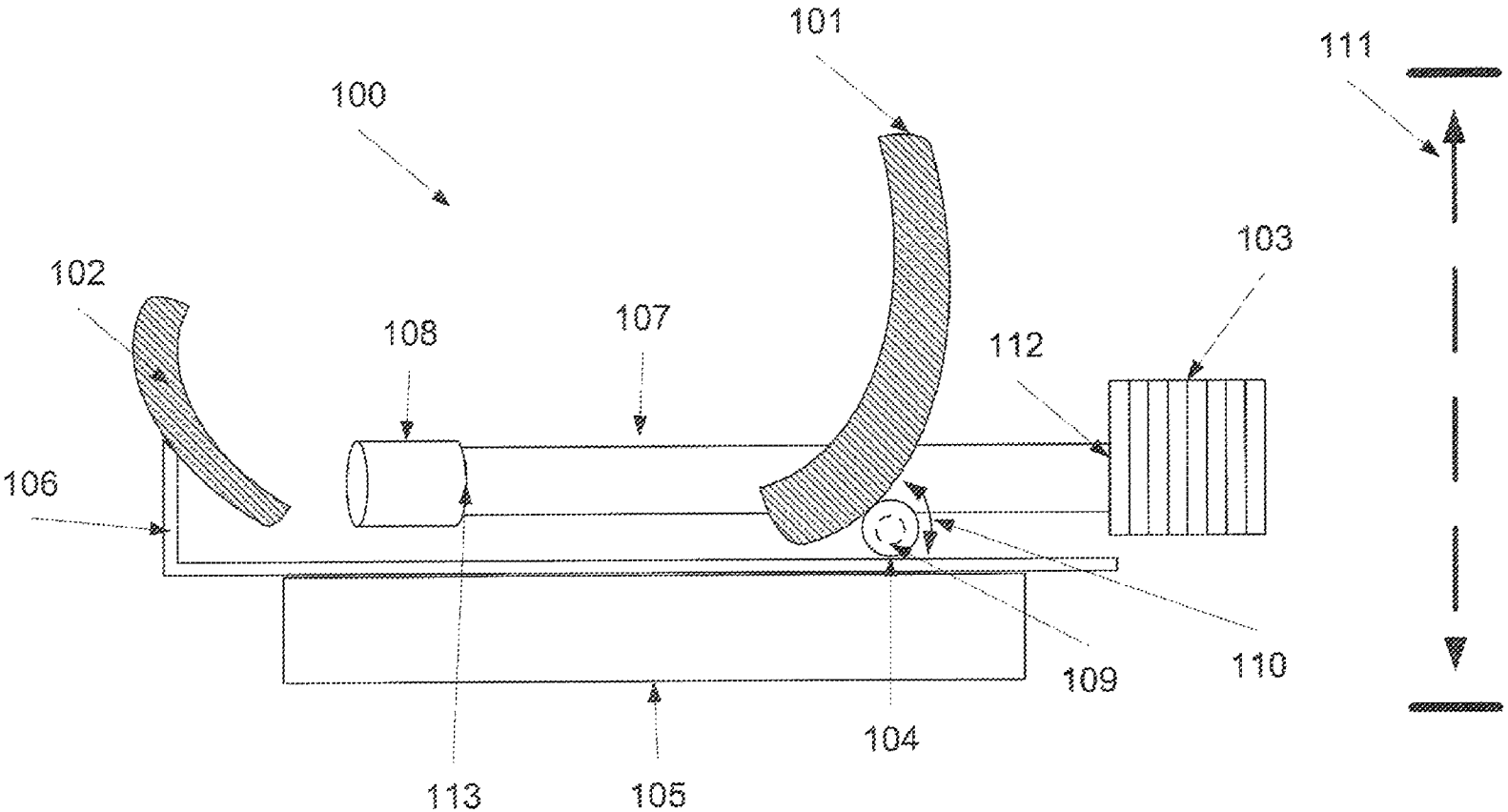
FIG. 1 is a schematic illustration of a vehicle mounted antenna for communicating with a communicating system, such as a satellite, according to some embodiments of the present invention.

The present invention, in some embodiments thereof, relates to an apparatus and a method for vehicle-mounted antennas and, more particularly, but not exclusively, to an apparatus and a method for vehicle-mounted antennas for satellite communication.

According to some embodiment of the present invention there is provided an antenna, such as a dual reflector antenna, for communicating with a satellite from a moving vehicle. The antenna, which may be referred to herein as a vehicle mounted antenna comprises a transmitter for generating transmission signals and/or a receiver for receiving and decoding signals, main and sub reflectors, feed horn and a waveguide designed for conducting the transmission signals toward the sub reflector and back. The transmitter is optionally connected to a polarizing element that is mounted behind the main reflector and allows the polarization of the transmission signals. The sub reflector redirects the transmission signals toward the main reflector that projects the redirected transmission signal as an antenna beam toward the satellite. As a waveguide is used for conducting the transmission signals toward the sub reflector and not other connecting cable such as coaxial transmission lines, both the transmitter and the polarizing element can be positioned behind the main reflector and to increase the effective reflective space of the antenna, as further described below.

According to some embodiment of the present invention there is provided an antenna for communicating with a satellite from a moving vehicle that comprises a rotational base which is designed to be mounted on the moving vehicle, a main reflector that can be tilted around a tilting axis which is located in a proximity to a lower portion of the main reflector. The antenna further comprises a feed for emitting a transmission signal and a sub reflector for redirecting the transmission signal toward the main reflector that projects the redirected transmission signal as an antenna beam toward the satellite. Optionally, the main reflector is designed to be tilted while the feed and the reflector are substantially stationary in relation to the rotational base. The tilting of the main reflector allows the maintaining of a line of sight between the main reflector and the satellite during a motion of the moving vehicle. The tilting axis of the main reflector allows the generation of a vehicle mounted antenna with a low vertical profile, for example as further described below.

The design of the antenna allows the reception and the transmission of communication signals. Thus, for brevity, in some sections of the description, only the transition logic between the reception and the transmission of communication signals is described.

Before explaining at least one embodiment of the invention in detail, it is to be understood that the invention is not necessarily limited in its application to the details of construction and the arrangement of the components and/or methods set forth in the following description and/or illustrated in the drawings and/or the Examples. The invention is capable of other embodiments or of being practiced or carried out in various ways.

Reference is now made to FIG. 1, which is a schematic illustration of a vehicle mounted antenna 100 for communicating with a remote communicating system, such as a satellite (not shown), according to some embodiments of the present invention. The vehicle mounted antenna 100, which is a dual reflector antenna, comprises a main reflector 101 and a sub reflector 102 which are facing one another. Each one of the reflectors 101, 102 has a reflective surface profile, optionally substantially ellipsoidal, as further described below and depicted in FIG. 2, which is a schematic illustration of an exemplary set of reflectors 101, 102, according to some embodiments of the present invention. The vehicle mounted antenna 100 further comprises a transmission and/or receiving unit 103 for generating and/or intercepting communication signals. As used herein, a communication signal is a transmission signal, a satellite signal, and/or any communicating system signal that is received by the vehicle mounted antenna 100 and a transmission and/or receiving unit 103 means a radio frequency (RF) transmitter, an RF receiver, a polarizing element, a transceiver, and/or any combination or portion thereof. Optionally, as depicted in FIG. 1, the transmission and/or receiving unit 103 is positioned behind the main reflector 101. In such a manner, the space between the sub-reflector 102 and the main reflector 101 does not contain any component or a sub-component of the transmission and/or receiving unit 103. In such a manner, as further described below, the efficiency of transmitting and receiving communication signals is increased.

For clarity, the reflective surface profile of the sub and main reflector 101, 102 are shaped in a commonly known process, such as a geometrical optics (GO) process of (geometrical optics) and/or a physical optics (PO) process for shaping reflective surfaces for antennas, see Brown, K. W. et al, a systematic design procedure for classical offset dual reflector antennas with optimal electrical performance, Antennas and Propagation Society International Symposium, 1993. AP-S. Digest Volume, Issue, 28 Jun.-2 Jul. 1993 Page(s):772-775 vol. 2, which is incorporated herein by reference. These processes are generally well known in the art and are, therefore, not described herein greater detail.

In some embodiments of the present invention, the Transmission and/or receiving unit 103 comprises an orthomode transducer (OMT) that combines and/or separates two RF signal paths. Optionally, the OMT is used for combining and/or separating between an uplink signal path and a downlink signal path, which are optionally transmitted over the same waveguide 107, for example as further described below.

The OMT, which may be referred to as an OMT/polarizer, supports polarization of the communication signals which are received by and/or transmitted from the transmission and/or receiving unit 103. The OMT supports circular polarization, such as left hand and right hand polarization, and/or linear polarization, such as horizontal and vertical polarization.

The vehicle mounted antenna 100 further comprises a waveguide 107 which may be referred to herein as a waveguide 107. The waveguide 107 has rear and front ends 112, 113. The rear end 112 is associated with a component of the transmission and/or receiving unit 103 in a manner that allows it to emit the transmission signals which are generated by the transmission and/or receiving unit 103 toward the sub reflector 102, via the front end 113 that is optionally connected to a feed horn 108. Optionally, the transmission signals are transmitted, using the sub and main reflectors 102, 101 with the reflective surface profiles which are described below, with a gain of more than 30 decibel isotropic (dBi) at 14 GHz or more than 25 dBi at 11 GHz. The sub reflector 102 redirects the emitted radiation toward the main reflector 101 that projects the radiation as an antenna beam toward the remote communicating system, which is optionally a satellite, for example a geostationary satellite (GEO satellite).

Optionally, the vehicle mounted antenna 100 further comprises a pedestal 105 for attaching it to a vehicle (not shown), such as a train, an automobile, a track, a bus, a boat, a ship, a plane, a helicopter, a hovercraft, a shuttle, and any other conveyance that transports people and/or objects. The pedestal 105 is optionally connected to a rotational base 106 that allows the rotation of the reflectors 101, 102, the waveguide 107, and the Transmission and/or receiving unit 103 or a portion thereof.

Optionally, the main reflector 101 is connected to one or more supporting elements 104 that allows the tilting thereof around a tilting axis 109 that is parallel to the rotational base 106, for example as shown at 110. In such a manner, the rotational base 106 may be used for simultaneously rotating the reflectors 101, 102, the waveguide 107, and the transmission and/or receiving unit 103 and the supporting elements 104 may be used for tilting only the main reflector 101 in relation to the rotational base 106. Optionally, the rotational base 106 is designed in a manner that allows continues rotation. In such a manner, the rotational base 106 can adjust the rotational angle of the reflectors 101, 102, the waveguide 107, and the transmission and/or receiving unit 103 by the fastest rotation operation.

Figure 3:
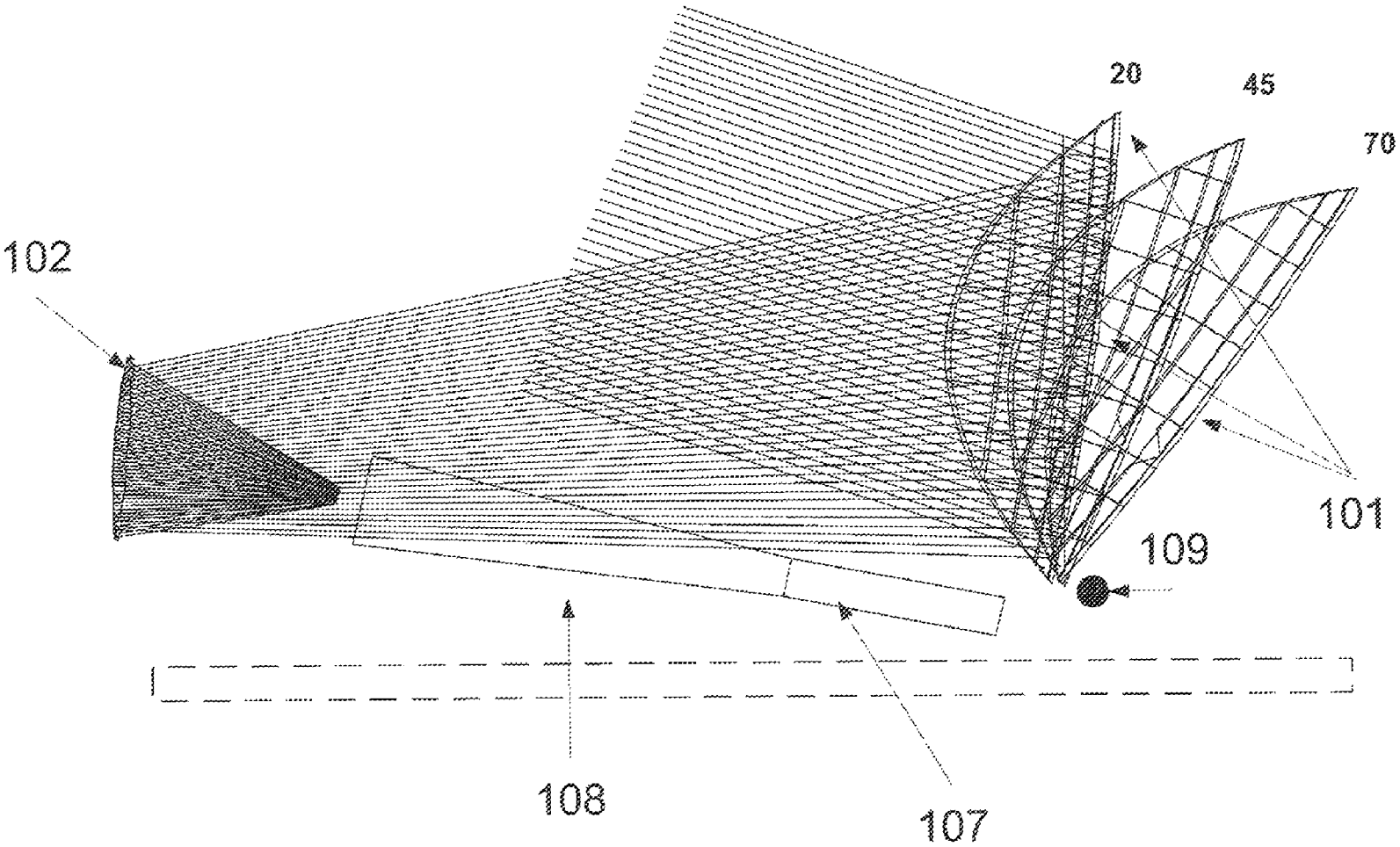
FIG. 3 is a schematic illustration of an electromagnetic radiation that is emitted from a waveguide feed toward a sub reflector and redirected toward a main reflector, according to some embodiments of the present invention.

Optionally, an edge portion of the main reflector 101 is disposed in proximity to the tilting axis thereof, for example as shown at FIG. 1. In such a manner, the vertical profile 111 of the vehicle mounted antenna 100 remains relatively low during the tilting of the main reflector 101. It should be noted that the vertical profile 111 may remain relatively low as the waveguide 107 is optionally not tilted with the main reflector 101. Furthermore, in such a manner, the main reflector 101 may rotate to change the tilt angle of the main lobe of the antenna beam while the waveguide 107 and/or the sub reflector 102 remain substantially or completely stable in relation to the rotational base 106. FIG. 3 is a schematic illustration of an electromagnetic radiation that is emitted from the feed 108 toward the sub reflector 102 and redirected toward the main reflector 101. The figure depicts three states of the main reflector that exemplify how the tilt angle of the main lobe of the antenna beam may be changed by tilting the main reflector around a tilting axis 109 in a proximity to the lower edge portion thereof without changing and/or substantially changing the positioning of the waveguide 107 and feed 108 and/or the sub reflector 102 in relation to the rotational base 106.

It should be noted that as the vehicle mounted antenna 100 uses the waveguide 107, it may have several advantages over a commonly used vehicle mounted antenna with coaxial transmission lines. For example, the waveguide 107 has substantially reduced dielectric losses. Furthermore, using the waveguide 107 instead of a coaxial transmission lines allows the positioning of the polarization element inside the transmission and/or receiving unit 103 behind the main reflector. In the commonly used antennas, the uplink signals, which are forwarded on the coaxial transmission lines, have to be polarized before they are emitted toward the sub reflector. Similarly, the intercepted downlink signals have to be polarized before they are transmitted over the coaxial transmission lines. Thus, in these antennas the polarization element has to be positioned in front of the main reflector. The waveguide 107, which is designed for conducting polarized waves without a substantial loss of power, allows the positioning of the polarization element behind the main reflector 101 and reduces the need to locate a polarizing element in the space between the main and the sub reflector. Such a shift may increase the effective reflective surface profile of the reflectors and may reduce the dielectric losses.

Figure 4B:
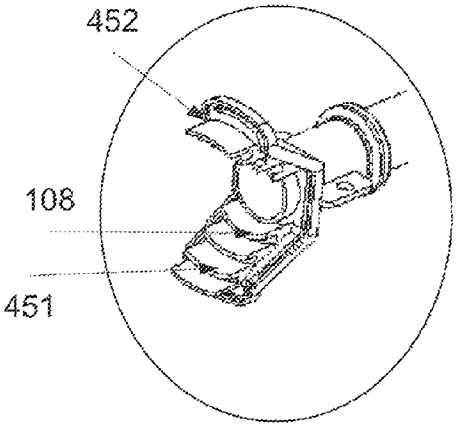
FIG. 4B is a schematic illustration of a magnification if a corrugated horn that is depicted in FIG. 4A, according to some embodiments of the present invention.
Figure 4A:
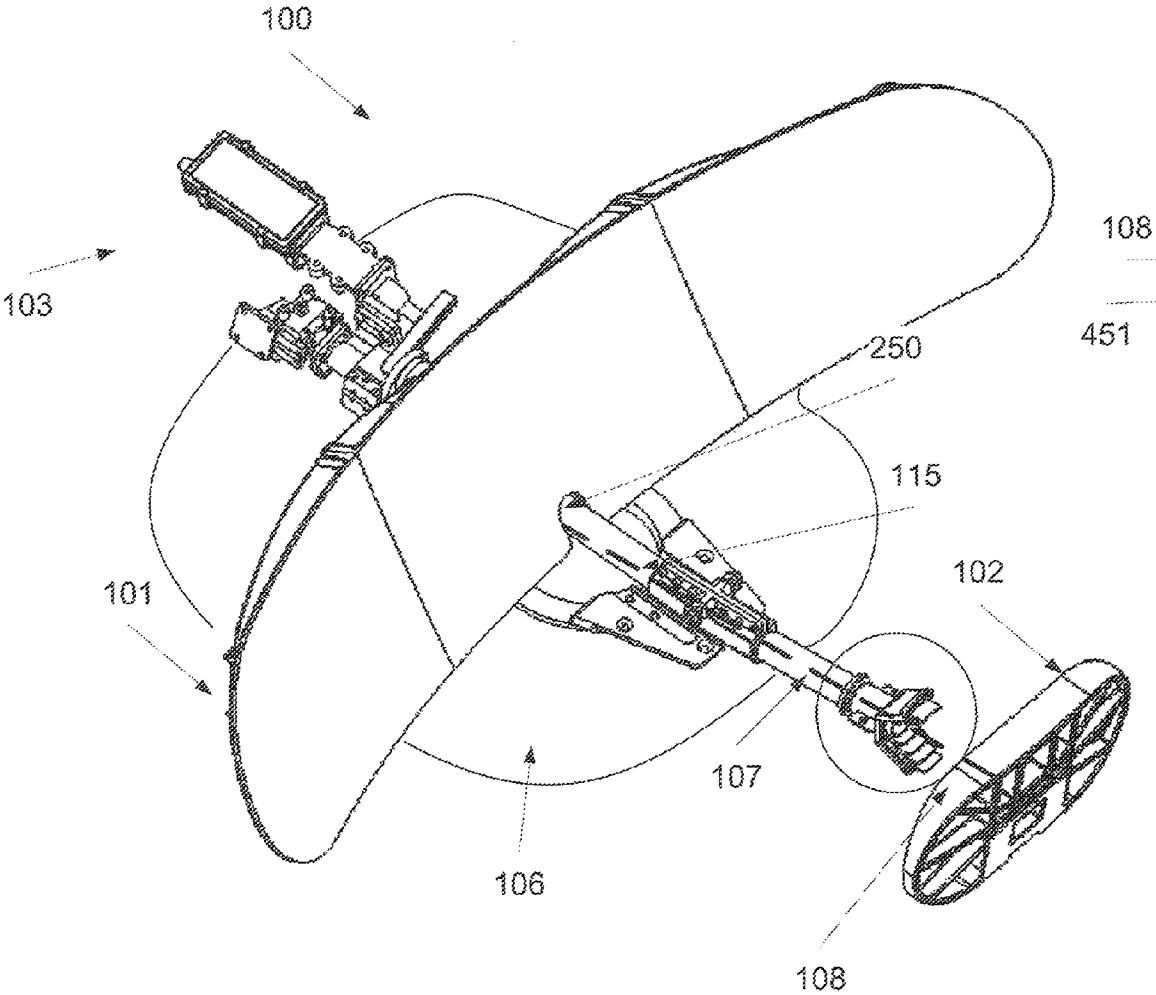
FIG. 4A is a schematic illustration of the vehicle mounted antenna, according to some embodiments of the present invention.

Reference is now made to FIG. 4A, which is a schematic illustration of the vehicle mounted antenna 100, according to some embodiments of the present invention. The components of the vehicle mounted antenna 100 are as depicted in FIG. 1; however FIG. 4A depicts exemplary reflectors, an exemplary waveguide, feed, and an exemplary transmission and/or receiving unit 103 in more detail.

Figure 2:
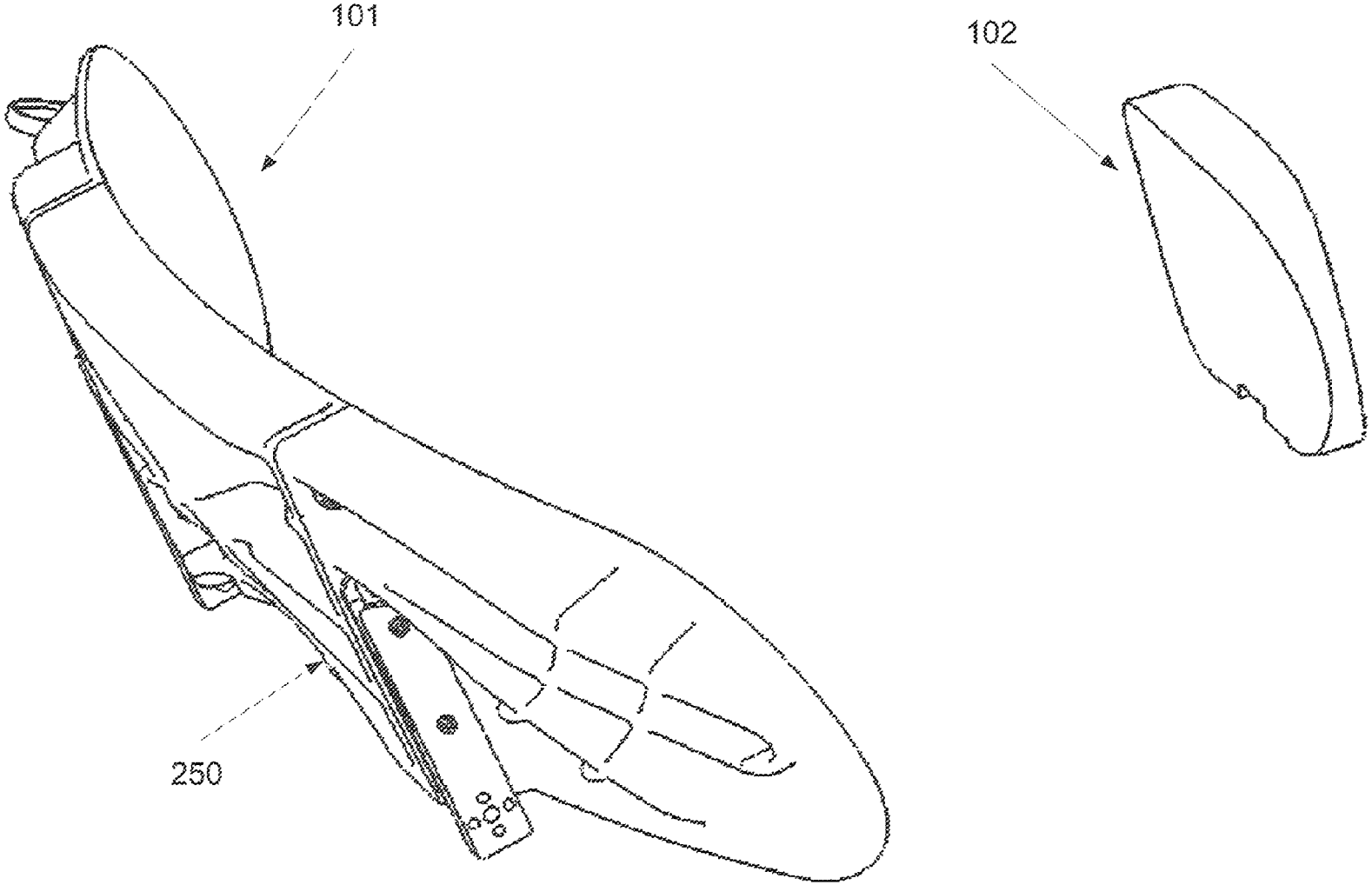
FIG. 2 is a schematic illustration of an exemplary set of reflectors of the vehicle mounted antenna of FIG. 1, according to some embodiments of the present invention.

As outlined above and depicted in FIGS. 2 and 4, the main reflector 101 and/or the sub reflector 102 are elliptical. The elliptic shape allows the generation of a vehicle mounted antenna with relatively low profile. Optionally, the vertical dimension of the main reflector is less than 240 millimeter and the vertical dimension of the vehicle mounted antenna 100 that is depicted in FIG. 4A, without an optional radome, is less than 250 millimeter. As further described below, the optional elliptic shape of the reflectors and the optional structure and optional operation of the waveguide 107 allows the assembly of a flat radome that adds less than 5 millimeter to the total vertical dimension of the vehicle mounted antenna 100. It should be noted that the vertical dimension of the reflectors 101, 102 allows the generation of a vehicle mounted antenna 100 with diameter:height ratio of more than 3.5:1.

In such an embodiment, the waveguide 107 is optionally designed to emit, via a feed horn 108, a substantially ellipsoidal conical beam toward the sub reflector 102. The substantially ellipsoidal conical beam creates an elliptical spot on the sub reflector 102. The sub reflector 102 redirects the beam toward the main reflector 101 that emits, accordingly, an elliptical antenna beam with uplink data toward a communicating system, such as a GEO satellite. It should be noted that the vehicle mounted antenna 100 may be used for communicating with a terrestrial communicating system. In such an embodiment, the vehicle mounted antenna 100 is installed on the bottom of a flying vehicle, such as an airplane or a shuttle. The main reflector, which is directed toward the communicating system during the motion of the vehicle on which the antenna is mounted, optionally as further described below, may allow the reception of signals from the satellite. The received signals are redirected toward the sub reflector 102 that concentrates them upon the feed horn 108 that is optionally conduct them, via the waveguide 107, to a receiver of the transmission and/or receiving unit 103. Optionally, the ratio between the width and the height of the elliptical spot that is created on the sub reflector 102 is approximately 1.5:1, 1.6:1, 1.7:1, 1.8:1 or more. The ellipsoidal conical beam is redirected by the sub reflector 102 toward the main reflector 101 to create an elliptical spot having a larger area and/or a higher elliptical ratio. Optionally, the ratio between the width and the height of the elliptical spot that is created on the main reflector 101 is approximately 3.5:1, 3.6:1, 3.7:1, 3.8:1, 3.9:1, 4:1, 4.2:1, 4.3:1, 4.4:1, 4.5:1, 5:1, 6:1, and 8:1. In such a manner, the reflective surface of the reflectors 101, 102 is better utilized and less power is lost during the transmission process. As further described above, the vehicle mounted antenna 100 may be used for receiving signals from the communicating system.

Reshaping the emitted transmission signals in two stages, both on the feed and the sub reflector, allows shaping the antenna bean in a more efficient shaping process. The shape and the size of the elliptical reflective surfaces of the sub and main reflectors 101, 102 and the shape and the size of the elliptical spots on the sub and main reflector 101, 102 allow the utilizing of all and/or most of the elliptical reflective surface of the reflectors 101, 102 without losing and/or substantially losing radiation power.

Figure 4C:
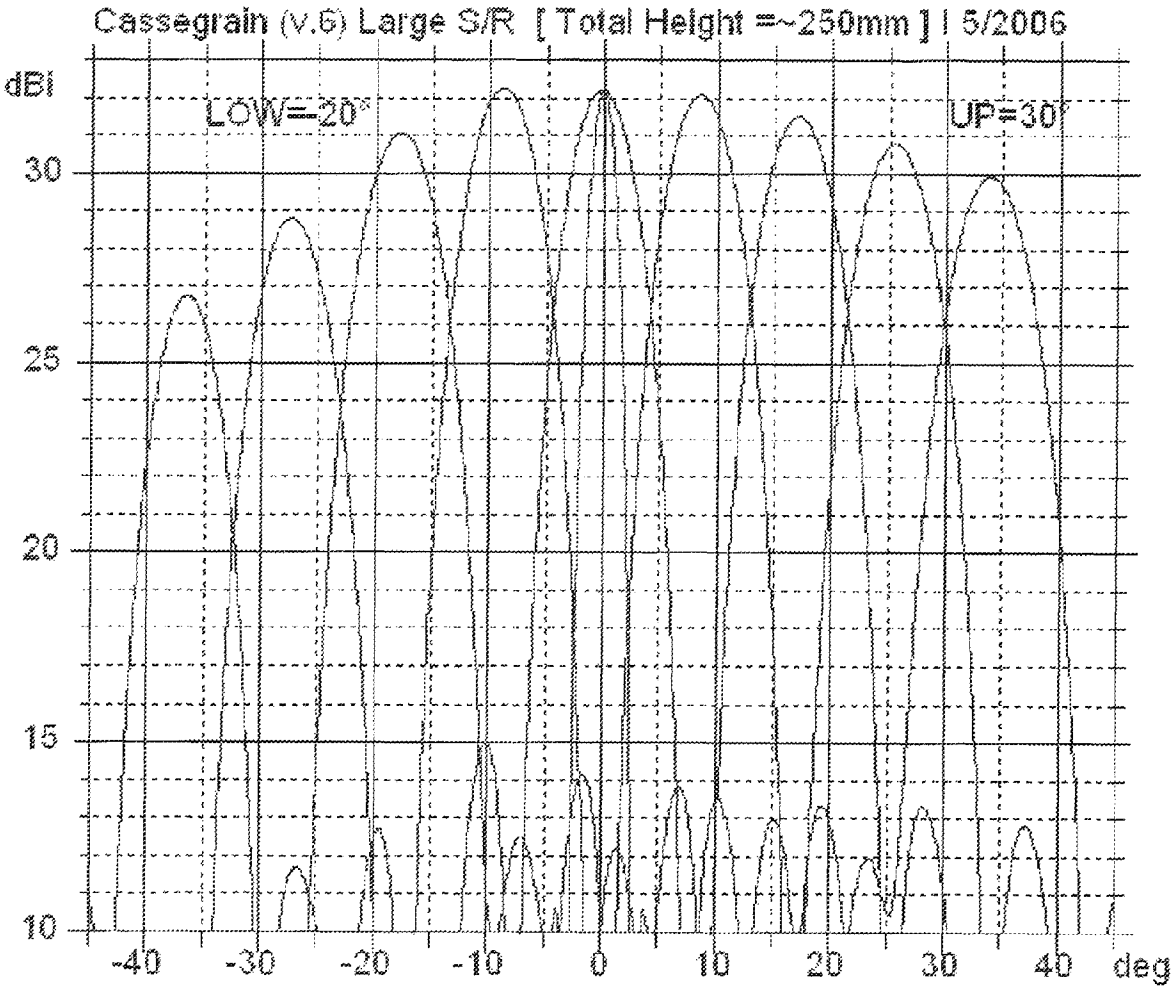
FIG. 4C is a graph depicting the antenna gain as a function of the tilting angle in a range of 50 degrees.

Furthermore, as further described above, the main reflector 101 is designed to be tilted in order to allow the adjusting of the elevation angle of the main lobe of the antenna beam. The tilting is optionally performed while maintaining the waveguide 107 and the sub reflector 102 in place in relation to the rotational base 106. The aforementioned structure of the vehicle mounted antenna 100 allows the tilting of the main reflector in an effective angle of more than 50, 55, and 60 degrees. Optionally, an effective tilting angle is defined as an angle in which the gain of the main lobe of the antenna beam remains within a range of less then 2 decibels degradation. For clarity, gain is expressed in decibels of gain of the vehicle mounted antenna 100 referenced to the zero dB gain of a free-space isotropic radiator (dBi). For example, as shown at FIG. 4C, which is a graph depicting the antenna gain as a function of the tilting angle in a range of 50 degrees, the gain degradation at center of the main lobe is no more than 1.90 db. Optionally, the tilting angle which is depicted in FIG. 4C is centered on an angle of 45 degrees in relation to the rotational base 106, As described above, optionally, the waveguide 107 is connected to a corrugated feed horn 108 in one end. Optionally, as shown at FIG. 4B, the horn includes a pair of corrugated plates which are diagonally mounted in relation to the central axis 115 of the waveguide 107, optionally as shown in FIG. 4A. The corrugated plates 451, 452 are mounted in a manner that their corrugated sides face one another. As the corrugated plates 451, 452 bound only the top and the bottom of the transmission perimeter, the transmission signals are beamed to create a spot with a high width:height ratio. The corrugated pattern of the corrugated feed horn 108 directs the emitted signals in a manner that all polarizations may exit/enter the feed.

Optionally, the height of the spot that is created on the sub-reflector does not exceed, or substantially exceed, the length of the sub reflector 102. As the gap between the palates is not bounded by the feed horn 108, the width of the transmission that is emitted from the waveguide 107 is longer then the height thereof. Such a feed horn 108 directs the transmission signals in a manner that creates a substantially ellipsoidal conical beam and allows the creation of an elliptical spot, optionally with a requested height-width ratio, on the sub reflector 102.

Figure 5:
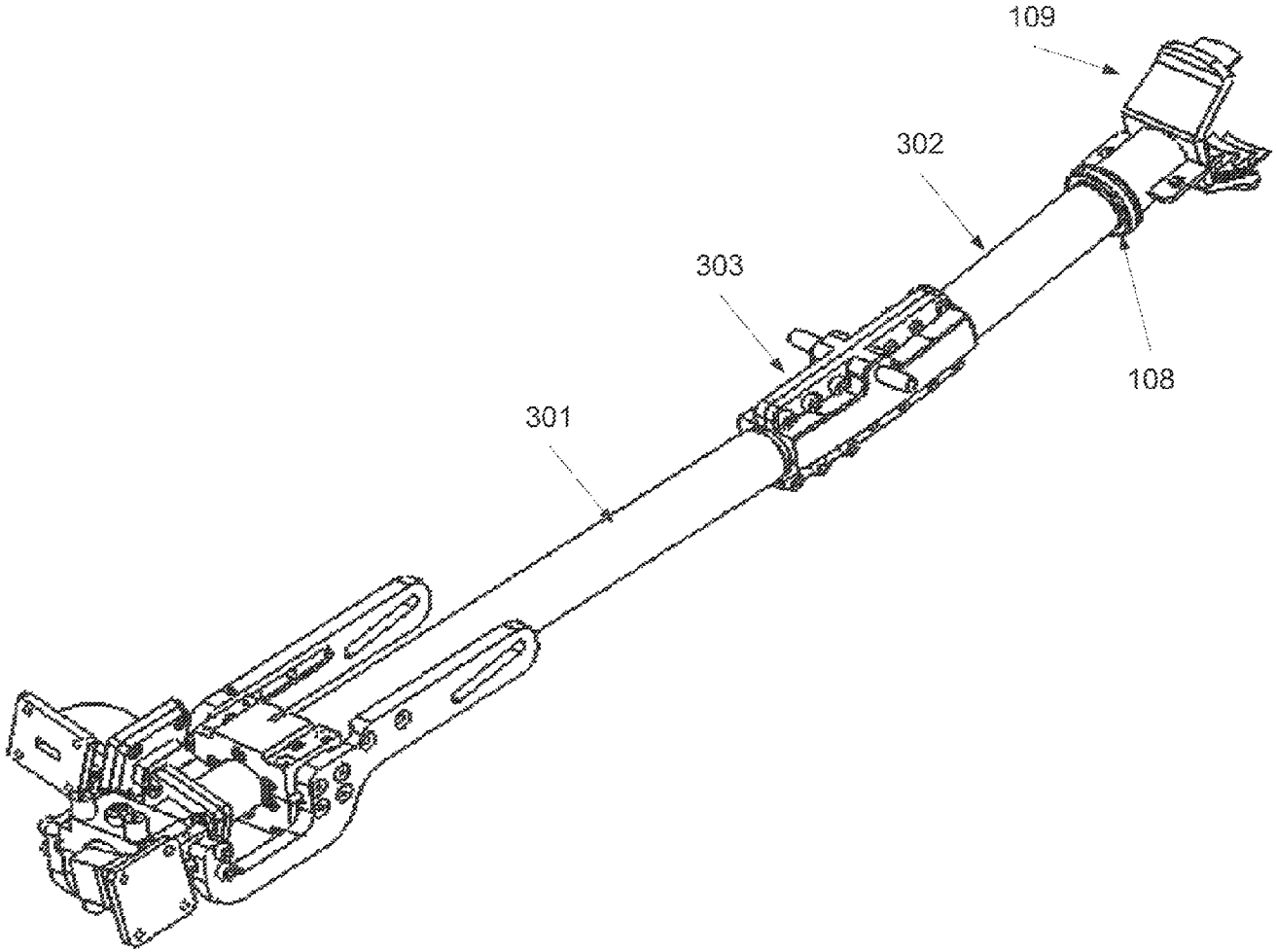
FIG. 5 is a schematic illustration of the exemplary waveguide feed that is depicted in FIG. 4A, according to some embodiments of the present invention.

Reference is now also made to FIG. 5, which is a schematic illustration of the waveguide 107 that is connected to the corrugated feed horn 108 in one side and to the transmission and/or receiving unit 103 in another, according to some embodiments of the present invention. Optionally, the waveguide 107 is mounted perpendicularly to the tilting axis of the main reflector 101, optionally in a proximity to the lower middle portion thereof, for example as shown at FIG. 4A. In some embodiments of the present invention, the waveguide 107 is bended in a manner that allows reducing of the height of the vehicle mounted antenna 100 and/or increasing of the effective reflective surface profile of the main reflector. The bending allows the mounting of the feed horn 108 to face the sub reflector while maintaining a substantial portion 301 of the waveguide 107 substantially parallel to the rotational base 106. Optionally, the waveguide 107 is designed to be positioned below and/or substantially below the main reflector 101. Such a bended waveguide 107 does not substantially increase the height of the vehicle mounted antenna 100. Furthermore, the profile of the waveguide 107 does not absorb and/or redirect the communication signals which are redirected from and/or directed to the sub reflector 102 and therefore does not reduce the effective reflective surface profiles of the sub and main reflectors 101, 102. The lower is the waveguide 107 the less it absorbs and/or redirects communication signals which are redirected from the sub reflector 102 and therefore the less it reduces the effective reflective surface profile of the main reflector 101. Optionally, the waveguide is bended in 5 or more degrees in relation to the central axis of said waveguide, for example in 5, 5.5, 6, 7, 8, 9, 10, 11, and 12 degrees. Optionally, the bend is created using a connector 303 that connects two waveguide elements 301, 302 to create the desired angle.

Optionally, the main reflector has a niche in the lower portion thereof, optionally as shown at 250 of FIGS. 2 and 4. The niche 250 allows the positioning of the waveguide 107 in the lower middle of the main reflector, perpendicularly to the main plane thereof.

In some embodiments of the present invention, the components of the transmission and/or receiving unit 103 is mounted behind the main reflector 101, as shown at FIG. 4A. In such a manner, the components of the transmission and/or receiving unit 103 do not absorb and/or redirect communication signals which are redirected by the sub reflector 102 toward the main reflector 101, as described above. Optionally, the transmission and/or receiving unit 103 comprises a receiver, a transmitter, and/or a polarization element. In such an embodiment, the transmission and/or receiving unit 103 may include a wave duct component, such as an OMT that combines and/or separates two wave signal paths. One of the paths allows the emitting of the communication signals via the waveguide 107 and optionally forms an uplink that is transmitted to a communicating system, as described above, and the other path is designed to be received via the waveguide 107, as a received signal path, for example as a downlink. The OMT, which is optionally an OMT/polarizer, assures that the paths are orthogonally polarized with respect to one another. The OMT may allow an orthogonal shift between the two signal paths and provides an isolation of approximately 30 dB in the Ku band and Ka band radio frequency bands.

Figure 7:
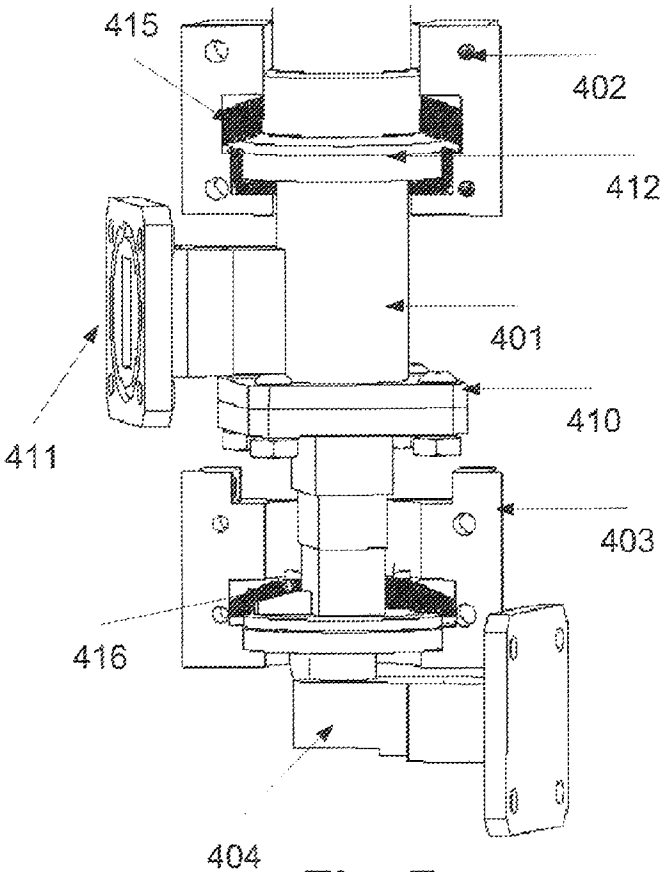
FIGS. 6 and 7 are respectively a schematic illustration a connection between a rotating OMT of an exemplary RF signal processing unit and the waveguide feed of FIG. 4A and a sectional schematic illustration this connection, according to some embodiments of the present invention.
Figure 6:
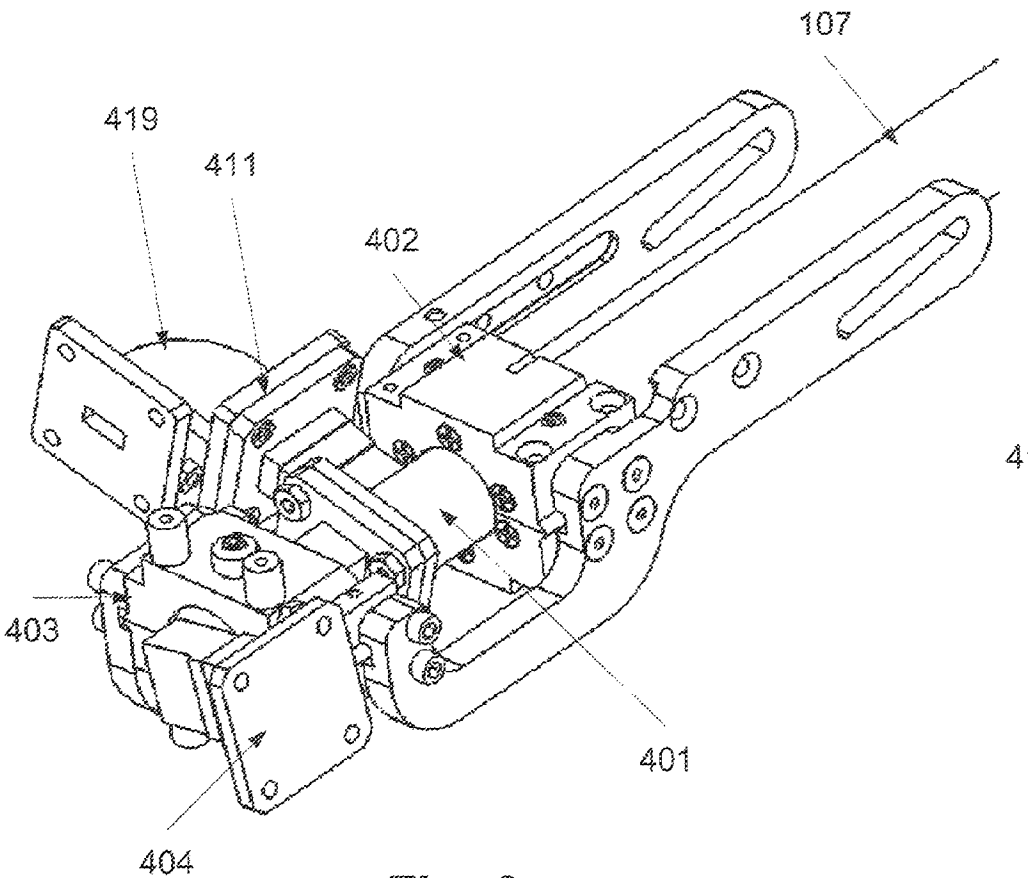

Reference is now made to FIG. 4 and to FIGS. 6 and 7, which are respectively schematic and sectional schematic illustrations of connections between a rotating OMT 401 and other components of the vehicle mounted antenna 100, according to some embodiments of the present invention. One of the depicted connections is between the rotating OMT 401 and an exemplary transmission and/or receiving unit 103. The other of the depicting connections is between the waveguide 107. The OMT 401 has a rear connector 410, a lateral connector 411, and a front connector 412. As depicted in FIGS. 6 and 7, the rotating OMT 401 is connected to a waveguide 107 using front and rear rotary joints 402, 403. The front rotary joint 402 provides a mechanical seal between the waveguide 107, which is optionally stationary, and the rotating OMT 401, to permit the transfer of polarized transmission signals into the waveguide 107 and/or intercepted signals from the waveguide 107. The rear rotary joint 403 provides a mechanical seal between a connector 404 that is optionally stationary in relation to the rotational base 106, and the rotating OMT 401 to permit the transfer of communication signals into and/or out of the waveguide 107 via the rotating OMT 401. Optionally, the mechanical seal that is formed by each one of the rotary joints 402, 403 is maintained by annular polymeric elements 415, 416 which are mounted and pressed, optionally using springs and/or screws, around the ends of the rotating OMT 401 and around the elements which are connected to the rotating OMT 401. For example, the front rotary joint 402 includes annular plastic elements which encircle the waveguide 107 and the front connector 412 and pressed to seal the space between them, for example as shown at FIG. 7.

As described above, the rotating OMT 401 is a polarization element and may be referred to herein as a rotating OMT/polarizer assembly 401. As described above, the rotating OMT/polarizer assembly 401 may support circular and/or linear polarizations optionally at Ku band and Ka bands. The polarization is optionally adjusted by a rotation of the rotating OMT/polarizer assembly 401. As described above, the rotating OMT 401 optionally rotates while the waveguide 107 and the connector 404 remain stable in relation to the rotational base 106. Furthermore, the polarization adjustment may be done while the vehicle mounted antenna 100 is on a move, for example as described below.

Optionally, the connector 404 is connected to a transmitter, such as a block up-converter (BUC) for transmitting uplink satellite signals via the waveguide 107. The BUC converts a band of frequencies from a lower frequency to a higher frequency, for example from L band to Ku band, C band and/or Ka band. Optionally, the power of the BUC is up to 1600 watt.

Figure 8:
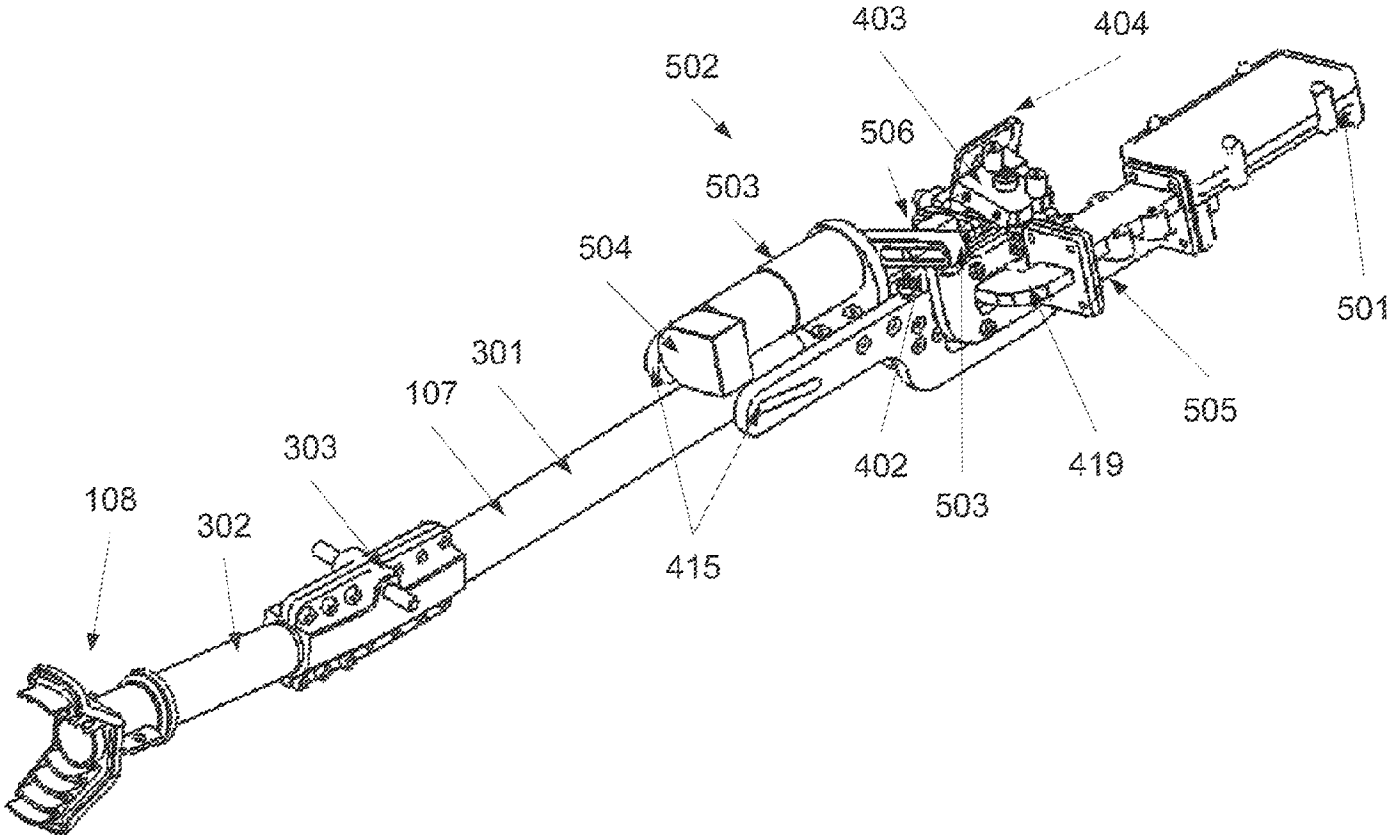
FIG. 8 is a schematic illustration of the waveguide feed of FIG. 4A and components of an exemplary RF signal processing unit, according to some embodiments of the present invention.

Reference is now also made to FIG. 8, which is a schematic illustration of the waveguide 107, the rotating OMT 401, an LNB converter 501, and a motion mechanism 502 for rotating the rotating OMT 401 and the LNB converter 501, according to some embodiments of the present invention. Optionally, the lateral connector 411 is connected to a receiving unit, preferably via a down converter and/or low noise block (LNB) downconverter, for example as shown at 501. The LNB downconverter 501 is designed to receive a band of relatively high frequencies from the rotating OMT 401, to amplify them, to convert them to similar signals carried at a lower frequency, which are also known as intermediate frequency (IF), and to forward the IF signals to a receiver, such as a satellite receiver. Optionally, the LNB downconverter 501 is attached to the rotating OMT 401 via a connection between the lateral connection 411 and an optionally filter 505, which is bended to form an L-shaped connection 419, for example as shown at FIG. 8. The bending of the connector 419 reduces the rotation profile of the LNB downconverter 501 and allows the generation of a vehicle mounted antenna with a smaller rotational volume. In such an embodiment, the LNB downconverter 501 is designed to rotate together with the rotating OMT 401 during the aforementioned polarization adjustment. As the LNB downconverter 501 is optionally connected to the rotating OMT 401 either directly and/or via a relatively short connector, optionally as shown at 411, the power of the communication signals that is forwarded by the rotating OMT 401 is not substantially reduced.

Optionally, the motion mechanism 502 includes a polarization motor drive 503, an encoder 504, and a lever 506 or any other mechanical assembly such as a tooth wheel, for transferring mechanical power from the polarization motor drive 503 to the rotating OMT 401 in order to rotate it along a certain rotating angle, optionally approximately 180 degrees. The encoder 504 is optionally connected to a central controller (not shown) which is designed to provide close loop control over the polarization to improve the communication with the communicating system by increasing the precision of the receiving and/or transmitting process. The encoder 504 is optionally an optical encoder, such as the HEDS-5500/5540, HEDS-5600/5640, and HEDM-5500/5600 of AVAGO Technologies™, which the specification thereof is incorporated herein by reference.

As described above, the waveguide 107 is connected to the transmission and/or receiving unit 103, optionally via the rotating OMT 401. The combination of these components may be referred to herein as a transmission and/or reception assembly. Optionally, the transmission and/or reception assembly is connected to a calibration track, for example as depicted in FIG. 415. The calibration track 415 allows a technician to calibrate the communication between the vehicle mounted antenna 100 and the communicating system. The technician may calibrate the communication by adjusting the distance between the feed horn 108 and the sub reflector 102. The adjustment is performed by maneuvering the position of the transmission and/or reception assembly on the calibration track 415. Optionally, the calibration track 415 allows the maneuvering of the transmission and/or reception assembly backward and forward along the central axis of the waveguide. As described above, the waveguide 107 is optionally bended. In such an embodiment, the calibration track 415 allows the maneuvering of the transmission and/or reception assembly in a manner that feed horn 108 is directed toward the sub reflector 102, for example along the axis of the waveguide element that is positioned between the connector 303 and the feed horn 108. After the calibration process, the technician secures the transmission and/or reception assembly to the calibration track 415 in a position that allows optimal or substantially optimal communication with the communicating system.

Figure 9:
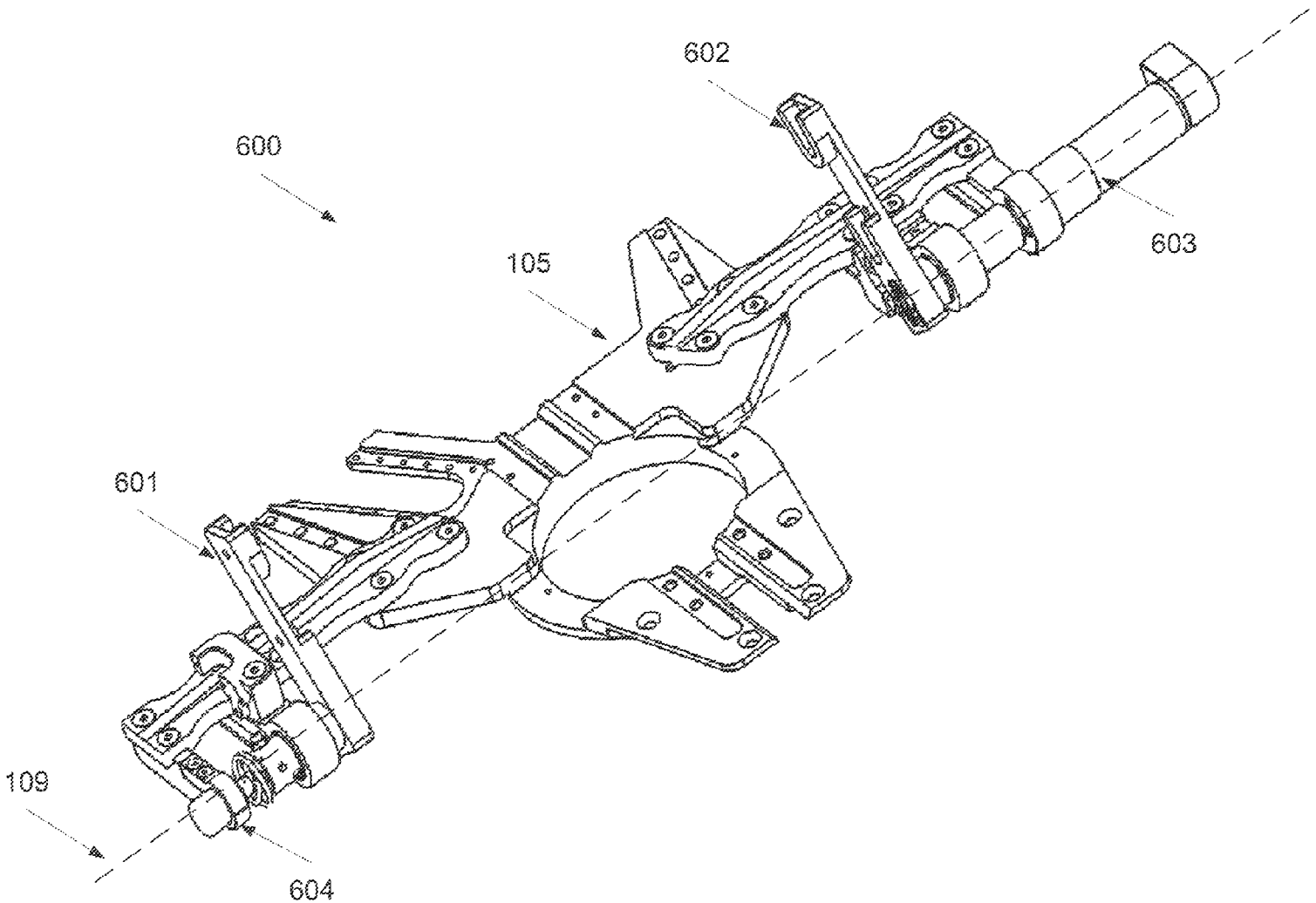
FIG. 9 is a schematic illustration of a tilt supporting mechanism for tilting the main reflector of the vehicle mounted antenna, according to some embodiments of the present invention.
Figure 10:
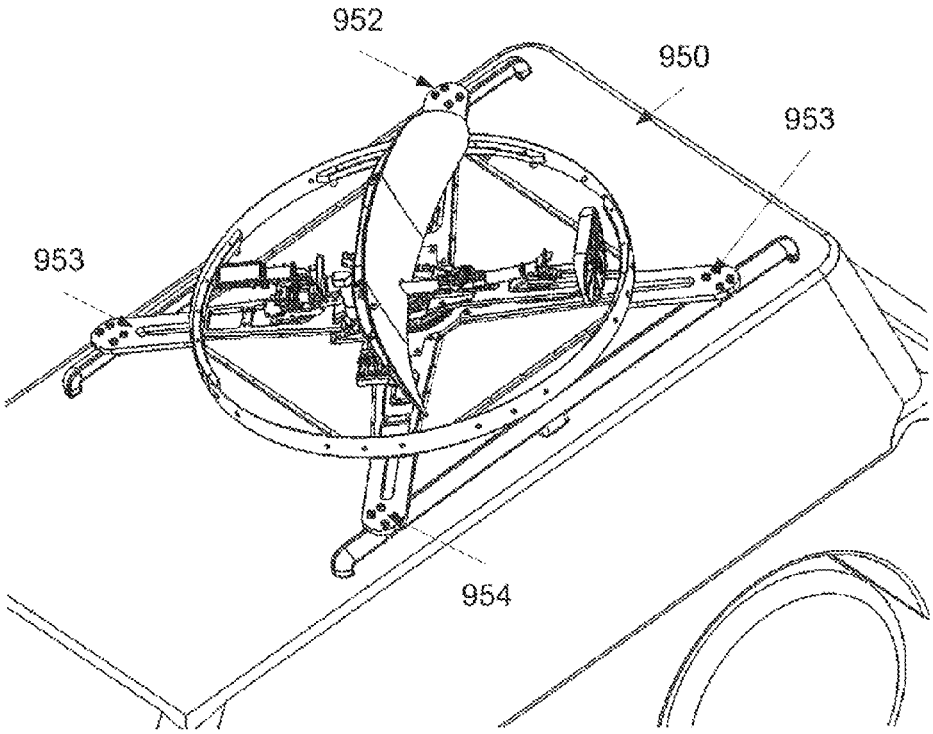
FIGS. 10 and 11 are a schematic illustration of a vehicle on which the vehicle mounted antenna 100 is mounted, according to some embodiments of the present invention.

Reference is now made to FIG. 1 and to FIG. 9, which is a schematic illustration of a tilt supporting mechanism 600 for tilting the main reflector 101 around the tilting axis 109, according to some embodiments of the present invention. As used herein tilting means adjusting the angle of the main reflector 101 in relation to the rotational base 106. The tilt supporting mechanism 600 comprises two supporting levers 601, 602 which are designed to be connected, optionally in a detachable manner, to the main reflector 101.

Optionally, each one of the supporting levers 601, 602 is designed to be connected to a different side of the main reflector 101. at lest one of the supporting levers 601, 602 is connected to a tilt motion drive 603 that is designed to maneuver the main reflector 101 around a tilting axis 109 that is parallel to the rotational base 106, for example as described above. Optionally, the angle of the main reflector 101 is between 15 and 80 degrees in relation to the rotational base 106. As described above, the waveguide 107 is designed to stay stable and/or substantially stable in relation to the rotational base 106 during the adjusting of the main reflector 101 angle. In such a manner, though the vehicle mounted antenna 100 may transmit an antenna bean with main lobe center that is directed in any angle between approximately 15 degrees and approximately 80 degrees in relation to the rotational base 106; it maintains a low profile, optionally as described above.

Optionally, the angle of at least one of the supporting levers 601, 602 is monitored by an encoder 604, such as an optical encoder, for example QD787 20 mm (0.787") Diameter Absolute Optical Encoder of QPhase™, which the specification thereof is incorporated herein by reference. The encoder 604 is optionally connected to the central controller that is designed to control the tilt motion drive 603 in order to adjust the tilt angle of the main reflector 101 according to location of the communicating system in relation to the vehicle mounted antenna 100, optionally as outlined above and described below. The central controller uses the data from the encoder 604 for maintaining a line of sight between the reflective surface of the main reflector 101 and the communicating system, which is optionally a GEO satellite. Furthermore, the adjusting of tilting angle of the main reflector 101 is done while the vehicle mounted antenna 100 is on the move, optionally as described below.

Optionally, the main reflector 101 and each one of the supporting levers 601, 602 is connected by a quick release mechanism, such as a screw and/or a nut fastening. In such a manner, the main reflector can be easily remove and/or assembled during the assembly of the vehicle mounted antenna 100 and/or the maintenance of vehicle mounted antenna 100. Optionally, the main reflector 101 may be replaced according to the geographic location in which the vehicle mounted antenna 100 is about to transmit and/or receive communication signals. In such an embodiment, the main reflector can be easily replaced to different reflector shape and optionally perform different tilting range of beam scanning, for example between 30 degrees and 90 degrees, when the vehicle mounted antenna 100 is transferred from one geographical location to another.

Figure 11:
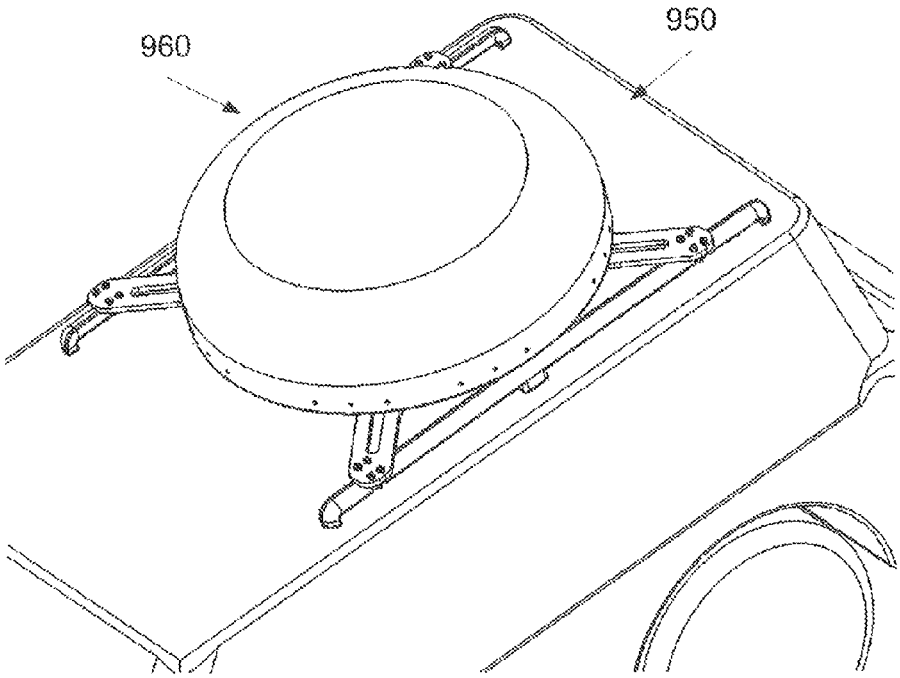

Optionally, as shown at 960, the vehicle mounted antenna 100 includes a radome that allows a relatively unattenuated electromagnetic signal between the vehicle mounted antenna 100 and the communicating system. Optionally, the radome structure has a flat top, for example as shown at FIG. 11. The flat top reduces the interfere of the vehicle mounted antenna 100 with the smooth airflow over the vehicle 950 and/or the effect of the vehicle mounted antenna 100 on aesthetics of the vehicle 950.

Reference is now made, once again, to FIG. 1. According to some embodiments of the present invention, the aforementioned motor drives are controlled by a central controller. The central controller is designed actuate the aforementioned motor drives in a manner that allows the tilting of the main reflector 101 and the rotating of the rotational base 106 toward a communicating system, which is optionally a GEO satellite. Optionally, the central controller is designed actuate one of the aforementioned motor drives to tune the polarization of the communication signals in order to improve the communication with the communicating system. Optionally, the actuation of the aforementioned motor drives is performed according to inputs from the aforementioned encoders and/or from one or more measuring units which are used for measuring positional data that is related to the position and/or the angle of the vehicle mounted antenna 100 and/or any component thereof in relation to the communicating system. As used herein, a measuring unit means an accelerometer for measuring the angle of the rotational base 106 and/or the aforementioned vehicle on which the vehicle mounted antenna 100 is mounted, a global positioning system (GPS) for determining the current latitude and/or longitude coordinates of the vehicle mounted antenna 100 and/or the aforementioned vehicle, and/or a compass for measuring the magnetic north in relation to the current orientation of the vehicle mounted antenna 100 and/or the aforementioned vehicle.

The directing of the main reflector 101 allows the transmitting of communication signals to the communicating system and/or the receiving of communication signals therefrom. As commonly known, a GEO satellite having a geosynchronous orbit such that the position in such an orbit is fixed with respect to the earth. When the vehicle mounted antenna 100 is installed on a moving vehicle, the central controller continuously directs the reflective surface of the main reflector 102 toward the GEO stationary satellite. In order to compensate for the movements of the vehicle, the central controller continually measures the current angular and translational position of the vehicle mounted antenna 100, optionally by using one or more of the aforementioned measuring units. This current angular and translational position information and optionally the current rotation, tilting, and/or polarization states, which are optionally acquired by one or more of the aforementioned encoders may be used by the central controller for calculating angular correction commands that maintain the reflective surface of the main reflector facing toward the satellite during the motion of the vehicle on which the vehicle mounted antenna 100 in mounted. The angular correction commands are for adjusting one or more of the current tilt of the main reflector, the rotation of the rotational base 106 of the vehicle mounted antenna 100, and/or the polarization of the emitted communication signals.

In one embodiment of the present invention, the vehicle mounted antenna 100 uses a beacon decoder for measuring the intensity, and optionally the quality, of a beacon signal that is received via the waveguide 107. An example for such a beacon decoder is Ku band beacon tracking receiver P/N 3430-KuAZ000 of Satellite Systems Corporation™, which the specification thereof is incorporated herein by reference. The beacon decoder detects the strength of the received beacon signal and the central controller calculates correction commands for adjusting the tilt of the main reflector, the rotation of the rotational base 106 of the vehicle mounted antenna 100, and/or the polarization of the emitted communication signals and/or the received signals accordingly. In particular, the beacon decoder decodes a satellite beacon signal and measures continuously the strength, and optionally the quality, thereof. Optionally, the central controller maneuvers the vehicle mounted antenna 100 in a scan pattern, for example a spiral scan pattern or a raster scan pattern and measures the strength of the satellite beacon signal during the scan. Such measurements allows the central controller to direct the current tilt of the main reflector 101, the rotation of the rotational base 106 of the vehicle mounted antenna 100 to a position and an orientation in which the strength and/or the quality of the beacon signal is high. Furthermore, such measurements allow the central controller to and/or to tune the polarization of the emitted communication signals to achieve the same goal. In such a manner, the reception of signals from the communicating system and/or the transmission of transmission signals thereto are improved.

Figure 12:
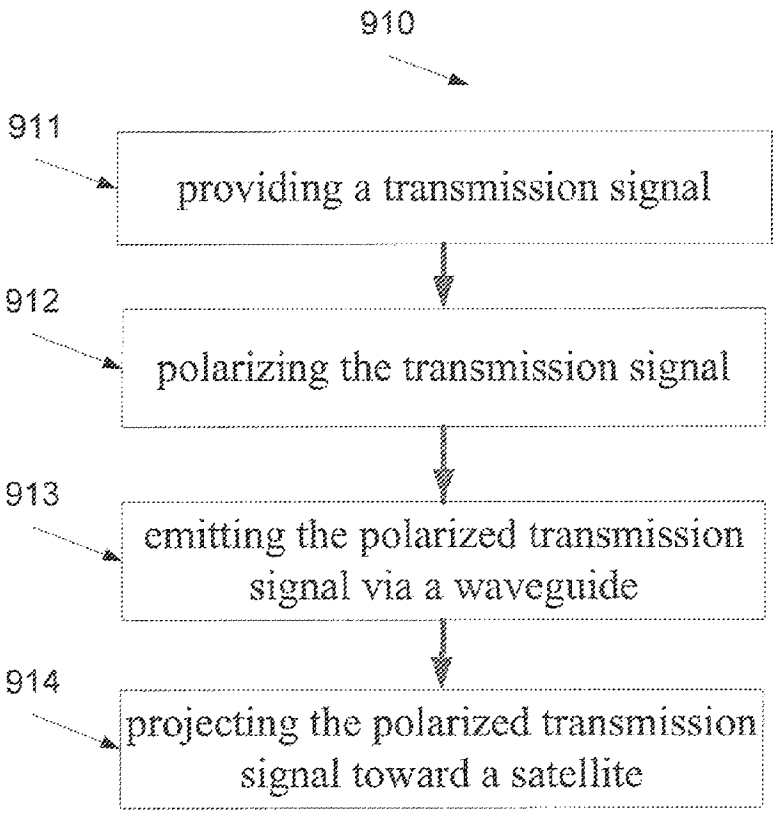
FIG. 12 is a schematic illustration of a method for transmitting a transmission signal to a satellite, according to some embodiments of the present invention.

Reference is now made to FIG. 12, which is a schematic illustration of a method 910 for transmitting a transmission signal to a satellite, according to some embodiments of the present invention. First, as shown at 911, a transmission signal is provided, optionally by a transmitter, such as a block up-converter (BUC) for transmitting uplink satellite signals via the waveguide, optionally as described above. Then, as shown at 912, the transmission signal is polarized, optionally using an OMT/polarizer. Now, as shown at 913, a waveguide is used for conducting the polarized transmission signal toward a sub reflector, optionally via a feed horn, for example as depicted in FIG. 3. As shown at 914, the emitted polarized transmission signal is redirected, optionally by a sub reflector, toward a main reflector to allow the projecting of the emitted polarized transmission toward the satellite as an antenna beam. The method 910 may be implemented using the aforementioned vehicle mounted antenna, optionally as described above.

Figure 13:
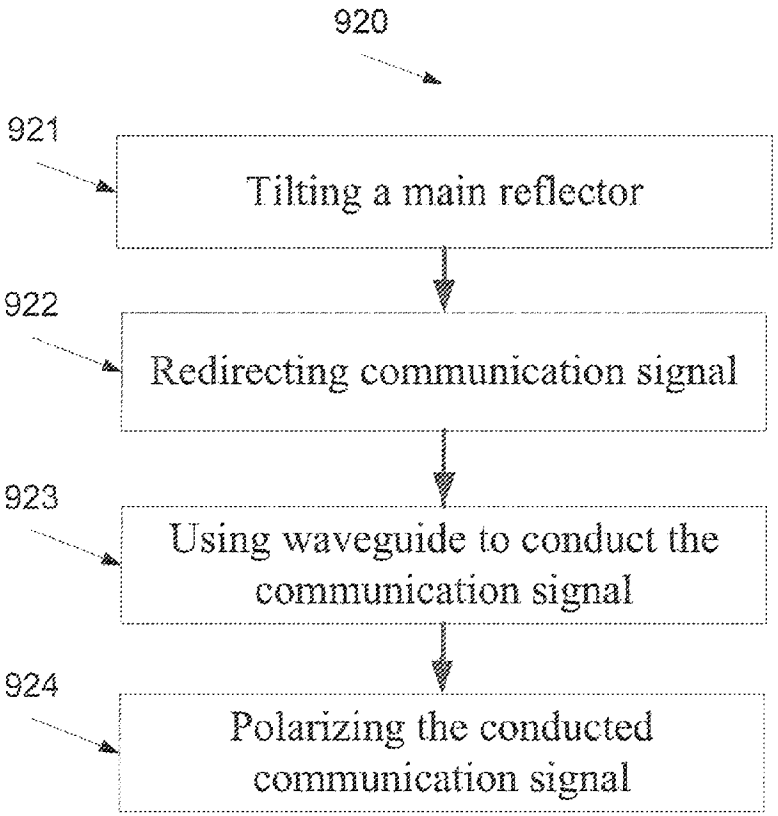
FIG. 13 is a schematic illustration of a method for receiving a communication signal from a satellite, according to some embodiments of the present invention.

Reference is now made to FIG. 13, which is a schematic illustration of a method 920 for receiving a communication signal from a satellite, according to some embodiments of the present invention. First, as shown at 921, a tilting angle of a main reflector of a vehicle mounted antenna is tuning to allow a reception of the communication signal from a satellite during the motion of the vehicle on which the antenna is mounted, optionally as described above. Then, as shown at 922, the communication signal is redirected toward a sub reflector. Now, as described above and shown at 923, a waveguide is used for directing a reflection of the redirected communication signal from the sub reflector toward a polarizing element. This allows, as shown at 924, the polarizing of the directed reflection. The polarizing allows the reception of the communication signal from the satellite and the forwarding thereof to a receiver, optionally via an LNB, for example as described above. The method 920 may be implemented using the aforementioned vehicle mounted antenna, optionally as described above.

As used herein the term "about" refers to ±10.

The terms "comprises", "comprising", "includes", "including", "having" and their conjugates mean "including but not limited to".

The term "consisting of means "including and limited to".

The term "consisting essentially of" means that the composition, method or structure may include additional ingredients, steps and/or parts, but only if the additional ingredients, steps and/or parts do not materially alter the basic and novel characteristics of the claimed composition, method or structure.

As used herein, the singular form "a", an and the include plural references unless the context clearly dictates otherwise. For example, the term "a compound" or "at least one compound" may include a plurality of compounds, including mixtures thereof.

Throughout this application, various embodiments of this invention may be presented in a range format. It should be understood that the description in range format is merely for convenience and brevity and should not be construed as an inflexible limitation on the scope of the invention. Accordingly, the description of a range should be considered to have specifically disclosed all the possible subranges as well as individual numerical values within that range. For example, description of a range such as from 1 to 6 should be considered to have specifically disclosed subranges such as from 1 to 3, from 1 to 4, from 1 to 5, from 2 to 4, from 2 to 6, from 3 to 6 etc., as well as individual numbers within that range, for example, 1, 2, 3, 4, 5, and 6. This applies regardless of the breadth of the range.

Whenever a numerical range is indicated herein, it is meant to include any cited numeral (fractional or integral) within the indicated range. The phrases "ranging/ranges between" a first indicate number and a second indicate number and "ranging/ranges from" a first indicate number "to" a second indicate number are used herein interchangeably and are meant to include the first and second indicated numbers and all the fractional and integral numerals therebetween.

As used herein, the term "treating" includes abrogating, substantially inhibiting, slowing or reversing the progression of a condition, substantially ameliorating clinical or aesthetical symptoms of a condition or substantially preventing the appearance of clinical or aesthetical symptoms of a condition.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable subcombination or as suitable in any other described embodiment of the invention. Certain features described in the context of various embodiments are not to be considered essential features of those embodiments, unless the embodiment is inoperative without those elements.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention. To the extent that section headings are used, they should not be construed as necessarily limiting.

What is claimed is:

1. A method for communicating through a satellite, comprising:

generating a transmission signal;

polarizing said transmission signal using an ortho-mode transducer (OMT);

radiating said polarized transmission signal via a feed horn so as to generate an ellipsoidal beam so as to create a first elliptical spot with a width-height ratio of at least 1.6:1 on a sub reflector; and redirecting said ellipsoidal beam toward a main reflector so as to create a second elliptical spot having a width-height ratio of at least 3.5:1 on said main reflector;

directing said ellipsoidal beam as an antenna beam toward the satellite; and rotating said OMT to adjust a polarization of said antenna beam.

2. The method of claim 1, wherein said rotating is performed while maintaining said width-height ratio.

3. The method of claim 1, wherein said polarization is selected from a plurality of polarizations between L band and Ku band and between C band and Ka band.

4. The method of claim 1, wherein said antenna beam having a third elliptical spot of at least at least 4:1.

5. The method of claim 1, wherein said antenna beam having a main lobe, said directing comprises tilting of the center of said main lobe in a range of at least 50 degrees in relation to a rotation plane of said main and sub reflector without a gain degradation of more than 2 decibels.

6. The method of claim 5, wherein said range is between tilting angles of more than 15 degrees in relation to said rotation plane.

7. The method of claim 5, wherein said tilting allows the tilting of the center of said main lobe in a range of at least 60 degrees.

8. The method of claim 5, wherein said antenna lobe has a gain selected from a group consisting of at least 30 decibel isotropic (dBi) at 14 Ghz and at least 25 decibel isotropic (dBi) at 11 Ghz.

9. The method of claim 1, wherein said directing is performed by at least one supporting element, said main reflector and said at least one supporting element being detachably coupled.

10. The method of claim 1, wherein said radiating is performed from a moving vehicle.

11. An antenna for communicating with a satellite from a moving vehicle, comprising:

main and sub reflectors;

a transmitter for generating a transmission signal;

an ortho-mode transducer (OMT) for polarizing said transmission signal;

a feed for radiating said polarized transmission signal so as to generate an ellipsoidal beam creating a first elliptical spot with a width-height ratio of at least 1.6:1 on said sub reflector; and wherein said sub reflector is set to redirect said ellipsoidal beam toward said main reflector so as to create a second elliptical spot having a width-height ratio of at least 3.5:1 thereon;

wherein said main reflector is set to direct said ellipsoidal beam as an antenna beam toward the satellite.

12. The antenna of claim 11, wherein at least one of said sub and main reflectors having a substantially ellipsoidal inner reflective surface profile.

13. The antenna of claim 11, wherein said feed is configured for radiating said sub reflector with a substantially ellipsoidal conical beam to create said first elliptical spot.

14. The antenna of claim 11, wherein said feed comprises a waveguide for conducting said polarized transmission signal from said OMT toward said sub reflector.

15. The antenna of claim 14, further comprising first and second rotary joints, said first rotary joint being disposed between said OMT and said waveguide and said second rotary joint being disposed between said OMT and at least one of a down converter, said transmitter, and a low noise block (LNB) downconverter.

16. The antenna of claim 15, wherein said first and second rotary joints allow adjusting the polarization of said transmission signal by facilitating the rolling of said polarizing element around the central axis of said waveguide while maintaining said waveguide firmly fixed in relation to said main and sub reflectors.

17. The antenna of claim 15, wherein at least one of said first and second rotary joints is less than 1 centimeter length.

18. The antenna of claim 14, further comprising a calibration track configured for allowing the adjustment of the position of said waveguide in relation to said sub reflector to calibrate said antenna beam.

19. The antenna of claim 14, wherein said waveguide having a feed horn connected to its end, said waveguide being configured for conducting said transmission signal toward said sub reflector via said feed horn.

20. The antenna of claim 14, wherein said waveguide having a bended passage.

21. The antenna of claim 20, wherein said bended passage having a bending angle of at least 5 degrees.

22. A method for receiving a communication signal from a satellite, comprising:

receiving, during a motion of a vehicle, a downlink signal from a satellite beam having a first elliptical spot with a width-height ratio of at least 3.5:1 formed on a main reflector of an antenna mounted on said vehicle;

redirecting said downlink signal so as to create a second elliptical spot with a width-height ratio of at least 1.6:1 on a sub reflector, said sub reflector being positioned in front of a waveguide;

using said waveguide for directing a reflection of the redirected downlink signal from said sub reflector toward an ortho-mode transducer (OMT); and polarizing the directed reflection to allow the reception of said communication signal from the satellite during said motion.

23. An antenna for receiving a downlink signal from a satellite from a moving vehicle, comprising:

main and sub reflectors, said main reflector is shaped so as to receive a downlink signal forming a first elliptical spot with a width-height ratio of at least 3.5:1 thereon and to redirect said downlink signal as an ellipsoidal beam creating a second elliptical spot with a width-height ratio of at least 1.6:1 on said sub reflector;

a feed for receiving a reflection of said downlink signal from said sub reflector;

a rotating ortho-mode transducer (OMT) located behind said main reflector and configured for polarizing said reflection; and a receiver for receiving said polarized reflection.

* * * * *